US008004476B2

(12) United States Patent
Takeuchi et al.

(10) Patent No.: US 8,004,476 B2
(45) Date of Patent: Aug. 23, 2011

(54) PLASMA DISPLAY DEVICE AND METHOD OF DRIVING THE SAME

(75) Inventors: Masanori Takeuchi, Tokyo (JP); Toshio Ueda, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 838 days.

(21) Appl. No.: 11/960,772

(22) Filed: Dec. 20, 2007

(65) Prior Publication Data

US 2008/0316148 A1 Dec. 25, 2008

(30) Foreign Application Priority Data

Jun. 21, 2007 (JP) ..... 2007-163293

(51) Int. Cl.
*G09G 3/28* (2006.01)

(52) U.S. Cl. ..... 345/63; 345/60; 315/169.2

(58) Field of Classification Search ..... 345/60, 345/63; 315/169.2
See application file for complete search history.

(56) References Cited

U.S. PATENT DOCUMENTS

| | | | | |
|---|---|---|---|---|
| 6,686,698 | B2 | 2/2004 | Takeuchi et al. | |
| 6,891,519 | B2 | 5/2005 | Ooe et al. | |
| 2003/0030655 | A1 | 2/2003 | Ooe et al. | |
| 2004/0251830 | A1 * | 12/2004 | Nagao et al. | 313/582 |
| 2005/0212725 | A1 | 9/2005 | Sasaki et al. | |
| 2005/0231444 | A1 * | 10/2005 | Takeuchi et al. | 345/63 |

FOREIGN PATENT DOCUMENTS

| | | |
|---|---|---|
| JP | 2003-122297 | 4/2003 |
| JP | 2003-280571 | 10/2003 |
| JP | 2003-337568 | 11/2003 |
| JP | 2005-274881 | 10/2005 |
| KR | 2003-0014103 | 2/2003 |
| KR | 2006-0044638 | 5/2006 |

* cited by examiner

*Primary Examiner* — Amare Mengistu
*Assistant Examiner* — Premal Patel
(74) *Attorney, Agent, or Firm* — Antonelli, Terry, Stout & Kraus, LLP.

(57) ABSTRACT

A technique capable of suppressing or preventing generation of flickers (blinks) by a sustain period control as well as capable of ensuring or enhancing display quality in a PDP device. The PDP device adjusts a sustain pulse of the sustain period for every subfield by selecting a combination of one or more than one cycle so that start and end timings of a field in fields before and after change are almost the same according to a display load ratio of the subfield of the field. Field weighted emission center positions then becomes almost the same, and flickers and the like are suppressed.

7 Claims, 9 Drawing Sheets

SUSTAIN PULSE CYCLE COMBINING CONTROL (SECOND PROCESS)

PLASMA DISPLAY DEVICE AND METHOD OF DRIVING THE SAME

CROSS-REFERENCE TO RELATED APPLICATION

The present application claims priority from Japanese Patent Application No. JP 2007-163293 filed on Jun. 21, 2007, the content of which is hereby incorporated by reference into this application.

TECHNICAL FIELD OF THE INVENTION

The present invention relates to a display device for performing a multiple grayscale display using a sub-field method (frame time division display method) of a plasma display device (PDP device) and the like comprising a plasma display panel (PDP). More particularly, the present invention relates to a configuration of a field (field period) and a subfield (subfield period).

BACKGROUND OF THE INVENTION

In a PDP device, an auto power control (APC) for changing the number (N) of sustain pulses of a subfield and adjusting the luminance and the power of display according to a display load ratio (H) of an image (display data) and the like and a control (hereinafter, referred to as sustain pulse cycle (C) control) for changing the sustain pulse cycle (C) of the subfield and enhancing the peak luminance according to the display load ratio (H) are conventionally known. The length (light emitting time) of a sustain period (Ts) can be changed in an increasing or decreasing manner by such controls (hereinafter, referred to as sustain period control).

In the sustain pulse cycle (C) control, the display load ratio (H) for every subfield is detected, and the sustain pulse cycle (C) is shortened only for the subfields having low display load ratio (H). The variation time (total value) in all the subfields generated as a result is distributed to each subfield so as to increase the number (N) of sustain pulses while maintaining the luminance weighting of each subfield. Such sustain pulse cycle (C) control is disclosed in Japanese Patent Application Laid-Open Publication No. 2003-337568 (Patent Document 1).

An example of technology for varying the sustain pulse cycle (pulse width) in a subfield is also disclosed in Japanese Patent Application Laid-Open Publication No. 2003-280571 (Patent Document 2). According to this technique, the pulse width is varied considering the sustain voltage (Vs).

Note that, in most conventional PDP devices, the sustain pulse cycle (C) of the sustain period of all the subfields in one field in a predetermined control is constant (only one type). Further, conventionally, there has not been proposed a technique of adjusting the timing of the subfield and the like using a combination of a plurality of sustain pulse cycles (C) in the sustain period like the present invention.

SUMMARY OF THE INVENTION (1) A first problem is as follows. According to the sustain period control described above, the start timing (temporal position) of each subfield in a field varies due to variation in sustain period length when the display load ratio (H) changes according to the image content (each subfield is arranged without gap). Thus, a weighted emission center position of each subfield and a weighted emission center position of the field (referred to as G) also vary. The variation in weighted emission center position becomes a cause of generation of flicker (blink) etc. in the screen (PDP display region) and it will be problematic in display quality.

Meanwhile, in the example of conventional technology, in a case of change where the sustain period length between fields is reduced, a consideration is made in making the start timing of each subfield of the field after the change as the same as that of each subfield of the field before the change. In this case, a gap is created between the adjacent subfields (sustain period) in the field. The variation in weighted emission center position (G) of the field is small compared to that when the subfields are arranged without the gap, but the weighted emission center position of each subfield still varies due to increase and decrease in the sustain period length, and thus the problem (flicker) cannot be sufficiently responded.

In another example of conventional technology, a consideration is made in aligning the start timing of the subfield in the middle of a field configuration (repetitive first subfield in a repetitive configuration of a subfield group of a predetermined luminance weighting) before and after a change. But the problem (flicker) still cannot be responded since the weighted emission center position of the subfield group varies.

As a countermeasure for the first problem, a configuration for uniformly and continuously changing the sustain pulse cycle (C) of the sustain period according to the magnitude of the display load ratio (H) may be proposed. However, in this case, hardware (circuit etc.) for freely generating and outputting a waveform of the sustain pulse cycle (C) having an arbitrary length must be installed in the PDP device in advance, and thus is not realistic. Conventionally, hardware capable of generating only a waveform of a specific sustain pulse cycle (C) is installed in the PDP device.

Further, another countermeasure is a configuration which responds to only one specific sustain pulse cycle (C). This is practicable but is difficult to match each timing and to match at least the end timing of each field by using only one sustain pulse cycle (C).

Furthermore, a second problem relating to the above first problem is as follows. The grayscale display is preformed through the subfield method in the PDP device, and thus the number (N) of sustain pulses to be assigned to each subfield in the field changes when changing the total number of sustain pulses of the field through a sustain period control of the abovesaid APC and the like. And, an influence thereof is larger for the low-order subfields related to the luminance weighting of the subfield, and it appears as a drastic luminance change. That is, for instance, in a case where the number (N) of sustain pulses changes from 1 to 2 in a first subfield (SF1) of a field. This becomes a cause of generation of flickering etc. in a low luminance region of the image, and it leads not only to flickers but also to the problem of display quality.

In view of the above problems, a main object of the present invention is to provide a technique capable of suppressing or preventing generation of flicker (blink) caused by a sustain period control (i.e., increasing or decreasing change in sustain period (subfield) length) in the PDP device, so that the display quality is ensured or improved. Another object of the present invention is to suppress generation of flickering and the like due to the influence (change in luminance) on the low-order subfields, and to ensure display quality.

The typical ones of the inventions disclosed in this application will be briefly described as follows. In order to achieve the above objects, the present invention provides a technique of a PDP device using a subfield method having the following configuration.

(1) In the PDP device of the present invention, for example, a subfield includes a sustain period in which display emission is performed by application of a sustain pulse to electrodes of a panel, and a process is performed in which a combination of one or more than one cycle (C) is selected for the sustain pulse of the sustain period for each subfield of the field according to the display load ratio (H) etc. of the subfield of the field (corresponded to image frame) and start and end timing (temporal positions) of the field are adjusted to be the same (almost the same) with those in the fields temporally previous and next to the field (in other words, fields before and after the change (adjustment)). If one cycle (C) is enough or appropriate, combination of two or more cycles (C) is not particularly necessary. Thus, adjustment is made such that the field weighted emission center position (G) becomes almost the same in previous and subsequent fields.

Further, particularly in the PDP device, a configuration for performing some sustain period control (APC, sustain cycle control etc.) according to the display load ratio (H) and the like, that is, a configuration for performing a first process for changing N and C to change a sustain period length is adopted, and a control (second process) of the cycle (C) combination is executed with the sustain period control (first process).

Still further, particularly in the PDP device, a configuration for arranging adjacent subfields of a field without creating a gap between the fields is adopted. In other words, respective sustain period lengths are made almost the same between the fields, the start timing of each subfield (sustain period) is aligned, so as not to provide a vacant period in the field period (all subfield driving period excluding vacant periods in a predetermined vertical period), so that the timing and the weighted emission center position of each subfield and field are made the same.

Moreover, particularly in the PDP device, the number (N) of sustain pulses of each subfield (sustain period) of the field may be maintained constant (configuration of changing only the sustain pulse cycle (C)). Finally, particularly in the PDP device, the number (N) of sustain pulses of each subfield (sustain period) of the field may be varied in an increasing or decreasing manner (a configuration of changing number (N) of sustain pulses by the APC and the like).

According to such configurations described above, the timing and weighted emission center position of the field and the subfield become almost the same between the fields, and thus flickers (blinks) and the like are suppressed.

(2) Furthermore, the following configuration is also provided in relation to (1). (A) As a first control, the APL (average luminance level) of the image frame in a target image and the APL differential value between the frames are detected to detect the presence of a predetermined variation (scene change) between the frames, and accordingly ON/OFF (apply/not-apply) of the control of the above (1) is switched. The control of the above (1) is turned OFF when a scene change is found (when the APL differential value is greater than or equal to a predetermined value).

(B) As a second control, the control of the above (1) is executed within a predetermined range (e.g., a divided region) instead of the entire range of the display load ratio (H) or the APL etc. For instance, a control is made in correspondence to a maximum length of field period (field end position) according to the predetermined range. For instance, the number of sustain pulses is maintained constant regarding a subfield in which a weight of the field is low-order.

According to the control of the above (2), generation of flickering etc. due to an influence on the low-order subfield is suppressed.

The effects obtained by typical aspects of the present invention will be briefly described below. According to the present invention, generation of flickers (blinks) by a sustain period control (increasing and decreasing variation of sustain period length) can be suppressed or prevented and the display quality can be ensured or enhanced in a PDP device. Furthermore, generation of flickering due to an influence on low-order subfield (luminance change) can be suppressed and display quality can be ensured.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted. In the following, a field is referred to as F and a subfield is referred to as SF, as necessary.

First Embodiment

A PDP device of a first embodiment of the present invention will be described with reference to FIG. 1 to FIG. 7. As an outline, in the PDP device having a function of sustain period control by a sustain pulse cycle (C) control, along with a process of the cycle (C) control (first process), a process for adjusting sustain pulse cycle (C) (second process, also referred to as control of sustain pulse cycle (c) combination) in which a combination of sustain pulses of one or more than one sustain pulse cycle (C) is selected to configure a sustain period based on the display load ratio (H) of an SF and the like is performed in the first embodiment. According to such process (second process), an adjustment is made between previous and subsequent fields to have timing (temporal position) of the field and each SF and the like almost the same, so that respective weighted emission center positions are almost the same.

<PDP Device>

Figure 1:
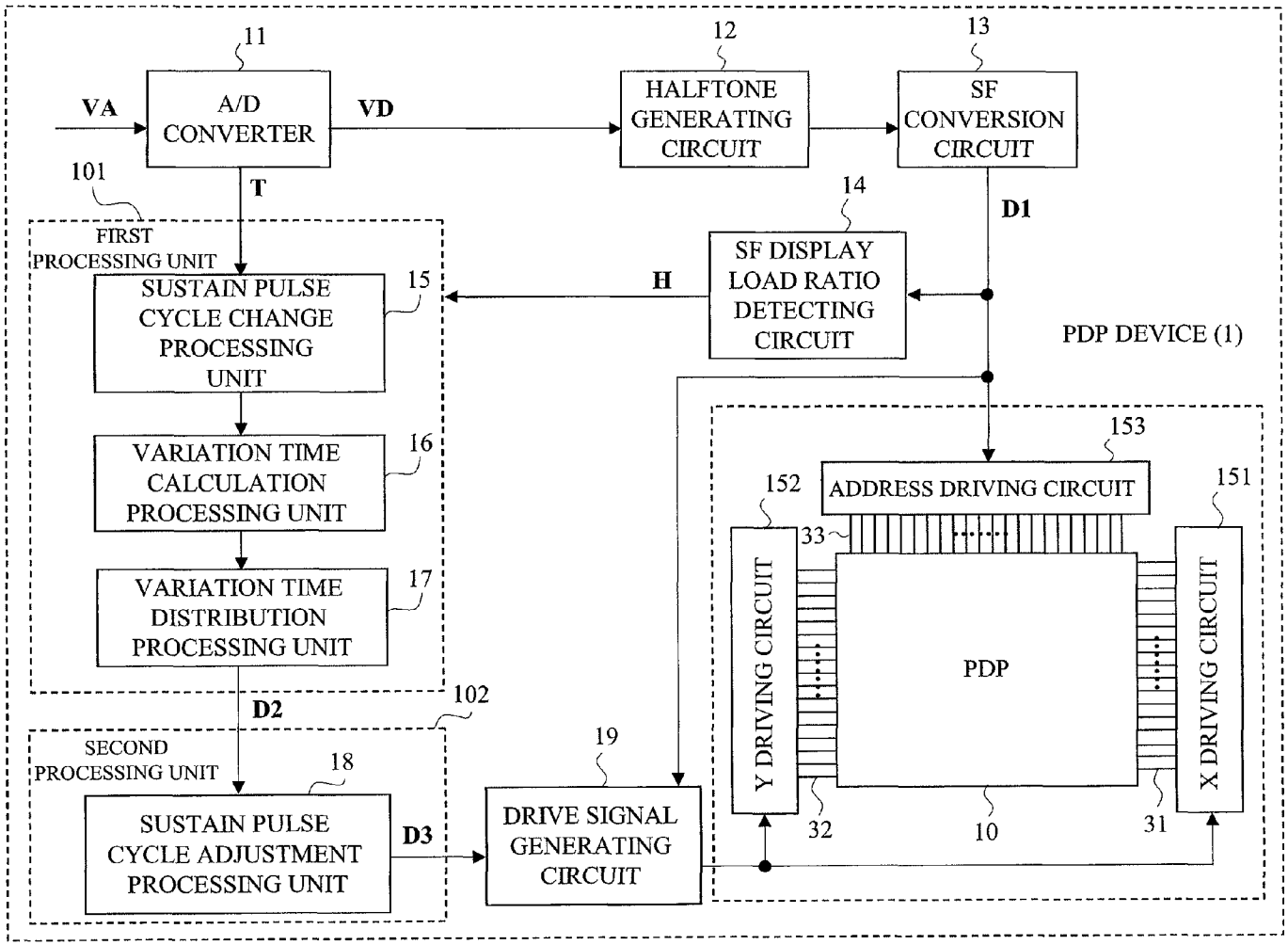
FIG. 1 is a diagram showing an entire block configuration of a PDP device according to a first embodiment of the present invention.

FIG. 1 shows a block configuration of the PDP device of the first embodiment. The PDP device includes a PDP 10 and a driving circuit (driver) including an X driving circuit 151, a Y driving circuit 152 and an address driving circuit 153, and a drive control circuit unit thereof includes: an A/D converter 11; a halftone generating circuit 12; an SF conversion circuit 13; an SF display load ratio (H) detecting circuit 14; a first processing unit 101 {sustain pulse cycle (C) change processing unit 15, a variation time (J) calculation processing unit 16, a variation time (J) distribution processing unit 17}; a second processing unit 102 {sustain pulse cycle (C) adjustment processing unit 18}; a drive signal generating circuit 19; and the like. Each driver (151, 152, 153) is connected to a corresponding electrode (31, 32, 33) of the PDP 10.

The first processing unit 101 performs the first process (sustain pulse cycle (C) control process) which once changes the sustain pulse cycle (C) etc. of each sustain period based on the display load ratio (H) of each SF of the field. The sustain pulse cycle (C) adjustment processing unit 18 as the second processing unit 102 performs the second process (sustain pulse cycle (C) combining control process) for changing the sustain pulse cycle (C) of each sustain period again to an appropriate combination based on the result of the first process to finally make an adjustment.

An input signal (VA) as an analog signal is converted to a digital signal in the A/D converter 11, whereby an image signal (VD) and a timing signal (T) are generated. The timing signal (T) is provided to respective units such as the first processing unit 101. The halftone generating circuit 12 adjusts the number of grayscales of the image signal (VD) through processes of dither, error diffusion etc. and outputs a grayscale signal thereof to the SF conversion circuit 13. The SF conversion circuit 13 determines a combination of lighting SFs in a display cell group of the field (F) to display each grayscale of the image frame (f) through an SF conversion process using an SF lighting pattern table with respect to the input grayscale signal, and outputs display data (field and SF data) (D1) representing such combination. The address driving circuit 153 and the like are drive-controlled based on the display data (D1).

The drive signal generating circuit 19 generates and outputs a drive signal for drive-controlling the X driving circuit 151 and the Y driving circuit 152 based on the display data (D1) (field configuring information etc.) (D3) of the second processing unit 102. The X driving circuit 151 applies a voltage (sustain pulse etc.) to an X electrode 31 group during a sustain period etc. of the SF based on the drive signal. Similarly, the Y driving circuit 152 applies a voltage (scan pulse and sustain pulse etc.) to a Y electrode 32 group during an address period and the sustain period etc. of the SF. The address driving circuit 153 applies a voltage (address pulse etc.) to an address electrode 33 group during the address period of the SF.

The SF display load ratio (H) detecting circuit 14 detects a display load ratio (H) for every SF of the field (one vertical period (1V)) based on the display data (D1). The display load ratio (H) for every SF is represented by a ratio of the number of lighted cells of each SF with respect to a total number of display cells of the entire field (display region). The H detecting circuit 14 outputs H information and the like. The format of the input/output data information between each section is not particularly limited.

In the first processing unit 101, the sustain pulse cycle (C) change processing unit 15 performs a process for changing the sustain pulse cycle (C) of each SF of the field according to the display load ratio (H) of each SF of the field. The C change processing unit 15 outputs the cycle (C) and field configuration information thereof or the changed display data. For instance, the C change processing unit 15 lowers the C when the H is large.

The variation time (J) calculation processing unit 16 calculates a variation time (J) (in other words, difference in total sustain period length of the field) of all the sustain periods in the relevant field and the field before a change according to the change in sustain pulse cycle (C) of each SF by the C change processing unit 15. The J calculation processing unit 16 outputs information such as a calculated variation time (J). For instance, the variation time (J) that becomes larger as the C becomes smaller is generated as a vacancy (rest period) in the field (1V) having a predetermined length.

The variation time (J) distribution processing unit 17 performs a process for distributing the variation time (J) calculated by the J calculation processing unit 16 to each SF of the relevant field in proportion to a product of a luminance weighting and the sustain pulse cycle (C) of each SF. In other words, the J distribution processing unit 17 performs a process for redistributing the time (J) once obtained by the C change to each SF by increasing and decreasing the number (N) of sustain pulses of each SF and adjusting the sustain period length. The J distribution processing unit 17 outputs information such as distribution time and number (N) of sustain pulses, field configuring information after the change by distribution, data (D2) of changed display data, or the like. For example, the number (N) of sustain pulses of each SF increases in accordance with the distribution time, and the sustain period length becomes longer.

In this manner, a field in which the N, C, sustain period length etc. are changed according to the H and the SF configuration data (D2) are obtained by the first processing unit 101.

The second processing unit 102 (C adjustment processing unit 18) performs a process for obtaining data (D3) such as field and SF configuration so as to satisfy a predetermined condition by further adjusting (selecting) the combination of the sustain pulse cycle (C) with respect to the field and SF configuration data (D2) of the output of the first processing unit 101 (J distribution processing unit 17). In the second process, the C adjustment processing unit 18 changes the cycle (C) of sustain pulse of a part of the sustain period of each SF to a different type so as to match the timing of the head (start) of each SF of the relevant field to that of the field before the adjustment. In other words, the C adjustment processing unit 18 selects a combination of the sustain pulse of one or more than one sustain pulse cycle (C) so that the timing of the sustain period of each SF is almost the same among the fields. Consequently, the sustain period length can be varied with respect to the field configuration (D2) before the adjustment while maintaining the number (N) of sustain pulses constant. Further, at this moment, all SFs in the field are lined on the time axis so as not to create a gap (rest period). According to such processes, the timing and the weighted emission center position of each SF (sustain period) and the field become almost the same with respect to the original field configuration (D1) in the field configuration after the adjustment. The second processing unit 102 (C adjustment processing unit 18) outputs C combination information or data (D3) such as adjusted field and SF configuration.

The change in the cycle (C) of the C adjustment processing unit 18 is performed by selecting one or more than one from a plurality of types of cycles (C) prepared in the present PDP device. A configuration capable of generating and outputting waveforms of the plurality of cycles (C) is provided in the circuit of the present PDP device.

Note that, in the configuration including a plurality of units, a configuration in which the order of detailed processes is changed may also be adopted. For instance, not limited to the configuration for changing the number (N) of sustain pulses after changing the sustain pulse cycle (C), also a configuration for changing the sustain pulse cycle (C) after changing the number (N) of sustain pulses may be adopted. Further, the APC similar to the conventional one or a sustain pulse cycle (C) control modified or applied from the APC can be realized by the first processing unit 101 of the first embodiment.

<PDP>

Figure 2:
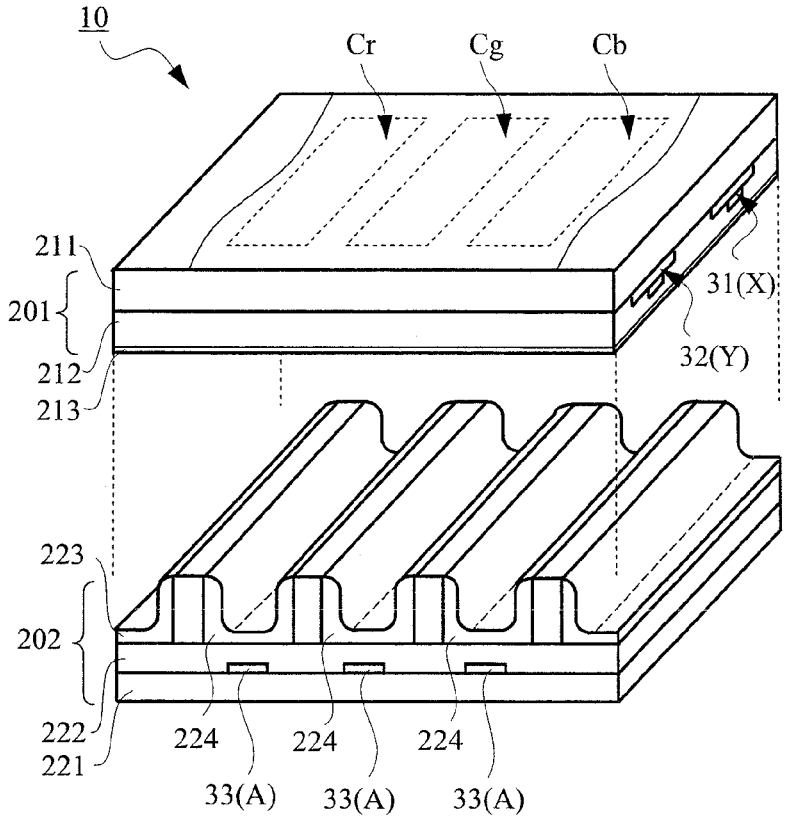
FIG. 2 is a diagram showing a configuration example of a display panel (PDP) in a PDP device of an embodiment of the present invention.

With reference to FIG. 2, a configuration example of the PDP 10 of the present PDP device will be described. One portion corresponding to a pixel is shown. The PDP 10 is configured by a combination of structures (front surface part 201, back surface part 202) of mainly a front glass substrate 211 and a back glass substrate 221, where the periphery thereof is sealed and a discharge gas is enclosed in the space therein. A display cell is formed in correspondence to intersections of an adjacent display electrode (sustain electrode 31, scanning electrode 32) pair and the address electrode 33. The pixel is configured by a set of cells (Cr, Cg, Cb) corresponding to respective colors.

In the front surface part 201, a plurality of pairs of the sustain electrode (X) 31 and the scanning electrode (Y) 32 are repeatedly formed in an alternate manner in a vertical (column) direction so as to extend to a horizontal (row) direction in parallel on the front glass substrate 211. The electrodes (display electrodes) are covered by a dielectric layer 212 and a protective layer 213. The display electrodes (31, 32) are configured by, for example, a transparent electrode and a metal bus electrode.

In the back surface part 202, a plurality of address electrodes (A) 33 are formed extending in parallel in a direction perpendicular to the display electrodes (31, 32) on the back glass substrate 212, and covered by a dielectric layer 222. Barrier ribs 223 extending in the vertical direction are formed on both sides of the address electrodes 33 on the dielectric layer 222. Further, phosphors 224 corresponding to respective colors of red (R), green (G), and blue (B) are applied between the barrier ribs 223.

<Field Configuration>

The field and SF configuration (drive sequence) will be described as a basis of the drive control of the PDP 10 according to the subfield method with reference to FIG. 4 described below. The field (F) (field period (TF)) is associated with the display region formed by the display cell matrix of the PDP 10 and a vertical period (V) of the image signal. The vertical period (V) is, for example, 1/60 sec. The field (F) is configured by a plurality of (n) of SFs (SF1 to SFn) temporally divided for grayscale representation. The n is 8 to 10. Each SF is configured with a reset period (Tr) 71, an address period (Ta) 72, and a sustain period (Ts) 73 in order. The SF of the field (F) is provided with luminance weighting by the number (N) of sustain pulses and the like, for example, it is a configuration where SFs are lined in the order from an SF having lowest-order weight. The grayscale of the pixel is represented by a step of selectively combining ON/OFF of the SFs (SF1 to SFn) of every corresponding display cell.

In Tr 71, a reset operation for preparing for the subsequent Ta 72 operation is performed by adjusting a charge state of the cell of SF to be as even as possible. In the subsequent Ta 72, an address operation for selecting the ON/OFF cell in the cell group of the SF is performed. Specifically, the address discharge is generated at a lighting target cell by applying a scan pulse to the scanning electrode 32 and an address pulse to the address electrode 33 according to the SF data. In the following Ts 73, a sustain operation for generating a sustain discharge in the cell selected in the immediately previous Ta 72 for emission display is performed by repeatedly applying a sustain pulse to the display electrode (31, 32) pair.

<Sustain Period Control (1)>

The sustain period (Ts) control such as basic (similar to conventional art) APC and the sustain pulse cycle(C) control, and changes in the field configuration etc. will be described with reference to FIG. 3 and FIG. 4. In the present embodiment, the sustain pulse cycle (C) control using the first processing unit 101 is performed.

Figure 3:
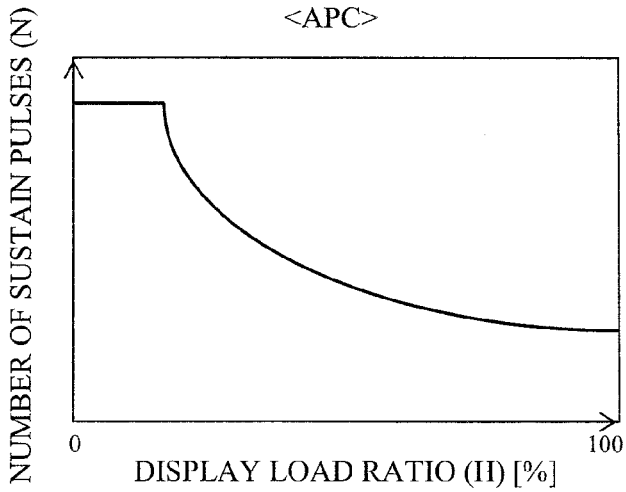
FIG. 3 CONVENTIONAL ART
FIG. 3 is a diagram showing an example of an APC control in the PDP device of the conventional art.

In FIG. 3, a relationship between the display load ratio (H) of the SF [%] and the number (N) of sustain pulses of the SF is shown as an example of the APC. In the process of APC, the number (N) of sustain pulses of the sustain period (Ts) 73 of the SF is increased and decreased according to the display load ratio (H) of the SF. In the present example, the number (N) of sustain pulses increases when the H is small (less than predetermined value), i.e., the Ts 73 becomes longer (especially showing a case of maintaining at a constant value), whereas the number (N) of sustain pulses decreases as the H increases when the H is large (greater than or equal to a predetermined value), i.e., the Ts 73 becomes shorter (especially showing a case of approaching a constant value).

As a process example of the sustain pulse cycle (C) control including the APC, the total number of sustain pulses decreases and the power reduces when the H is large, whereby a vacant period is created in the field, and the discharge is stabilized by changing the sustain pulse cycle (C). The C is made to be small in the field where the H is small, and the C is large in the field where the H is large.

Figure 4:
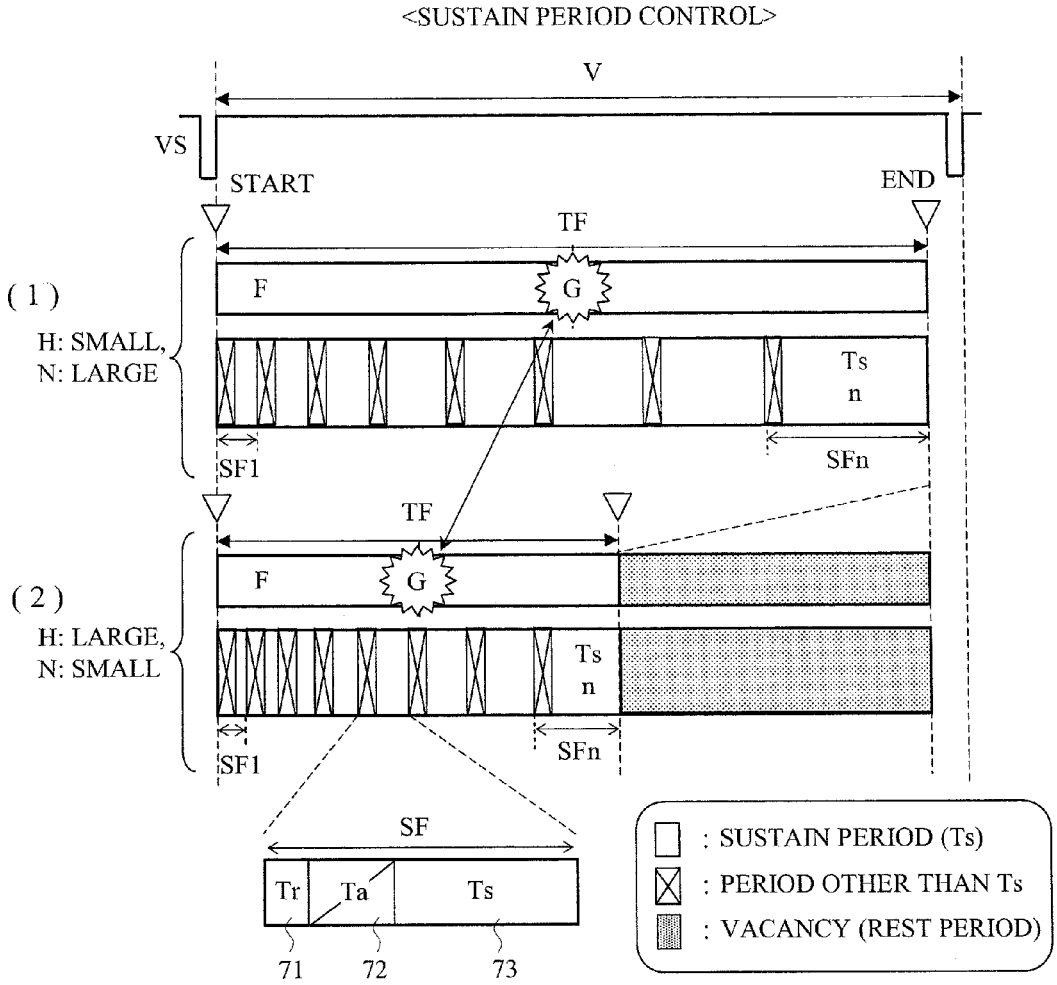
FIG. 4 CONVENTIONAL ART
FIG. 4 is a diagram showing a change in the field configuration and weighted emission center by a sustain period control (sustain pulse number control or sustain pulse cycle control) in the PDP device of the conventional art.

In FIG. 4, a change in the field configuration and weighted emission center corresponding to the Ts control is shown in correspondence to FIG. 3. The vertical period (V) having a predetermined length is defined by a VS (vertical synchronizing signal), which becomes a maximum length of the field (F) (field period (TF)). A case in which the field (F) is configured by SFs of n=8(SF1 to SF8) in the order the weight becomes larger is shown. Each SF includes the sustain period (Ts) 73 shown by a blank part, and periods (reset period (Tr) 71, address period (Ta) 72) other than the sustain period are shown by a portion marked by X. Herein, all the SF driving period from the first SF (SF1) to the last SF (SFn) of the field (F) is considered as one field period (TF), and the vacant period (rest period) and the difference with the 1V period are not taken into consideration. End timing of the field (F) is the end timing of the last SF (SFn). The sustain period (Ts) 73 corresponding to the i-th SF (SFi) of the field (F) is Tsi.

The field of (1) of FIG. 4 shows a case where the length of each SF (Ts) becomes relatively longer when the number (N) of sustain pulses (or cycle (C)) increases when the display load ratio (H) is small. The field of (2) of FIG. 4 shows a case where the length of each SF (Ts) becomes relatively shorter when the number (N) of sustain pulses (or cycle (C)) decreases when the display load ratio (H) is large. Between states of (1) and (2), the Ts length is increased and decreased while maintaining the weight of each SF and each SF is crammed towards the front in terms of time with no space in the field (1V period). Thus, a vacancy (rest period) is provided after the last SF (SFn) of the field as shown in (2). The vacancy (rest period) is associated with the variation time (J).

Comparing the field configurations of (1) and (2), the weighted emission center of each SF and the weighted emission center (G) of the field as well as the start (and end) timing of each SF and the end timing of the field are shifted. A triangular mark indicates the timing of start and end. The field weighted emission center (G) of (1) can be assumed as a schematic central position of the field period (TF). The field weighted emission center (G) of (2) is the same (vacancy is not taken into consideration). More strictly, the actual weighted emission center is slightly shifted if taking the SF weight and the Ts light emission luminance into consideration, but it is enough to consider only the schematic weighted emission center position when think about the effect of display. Further, regarding the timing and the weighted emission center, it is only necessary to consider the sustain period (Ts) 73 which is the main light emitting time of the SF period, and the timing etc. of the SF and the Ts are roughly same when it is assumed that the periods other than the Ts 73 have constant lengths.

As described above, when using the sustain period (Ts) control such as APC and sustain pulse cycle (C) control, the field weighted emission center (G) changes between the fields due to increase and decrease in SF (Ts) length and positional change corresponding to the image content (display load ratio (H) etc.). Accordingly, when the fields (frames) before and after the change are displayed in an alternately and subsequent manner, for instance, flickers (blinks) are generated.

<Sustain Period Control (2)>

Figure 5:
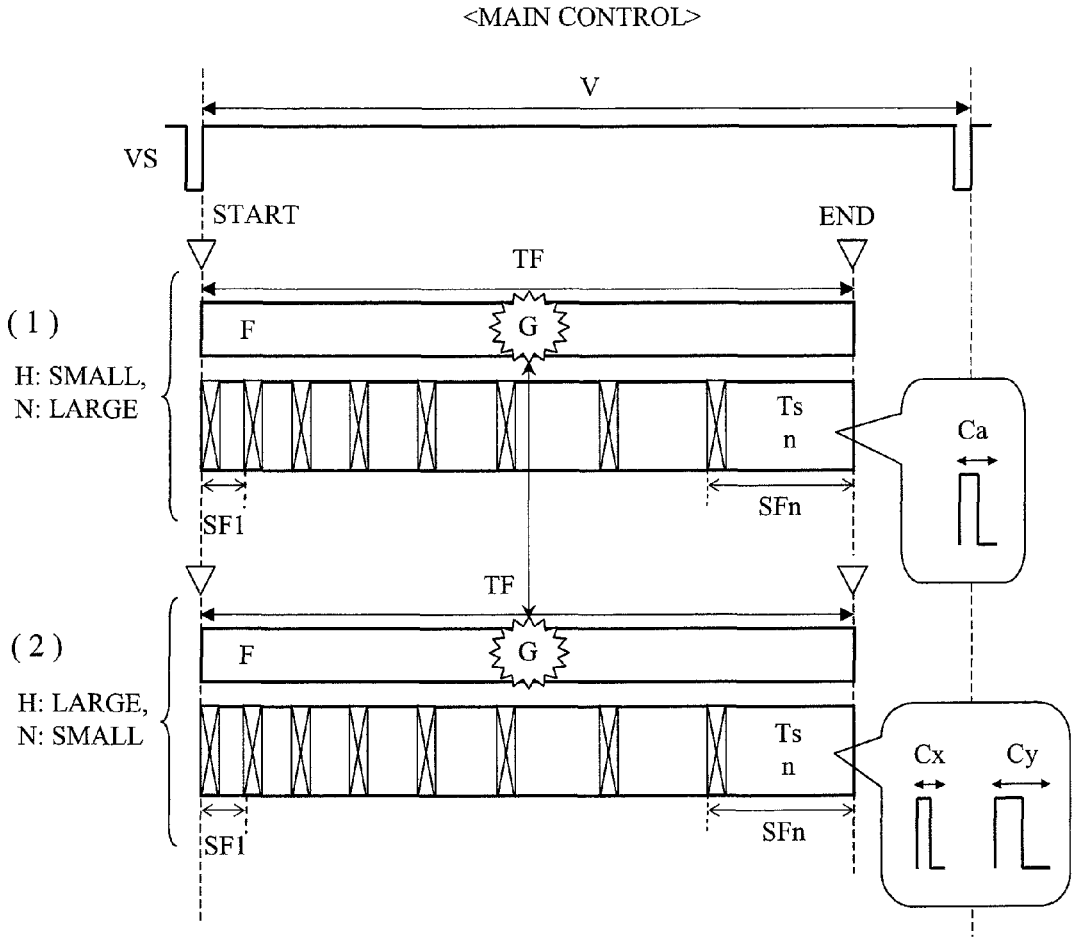
FIG. 5 is a diagram showing a change in the field configuration and weighted emission center by a control (control by a sustain period control and a sustain pulse cycle combining control) in the PDP of the first embodiment of the present invention.

Meanwhile, in the present embodiment, the change in field configuration and weighted emission center by the present control (sustain pulse cycle (C) control and sustain pulse cycle (C) combining control) using the first processing unit 101 and the second processing unit 102 will be described with reference to FIG. 5. In FIG. 5, changes in field configuration etc. in the present control is shown in a style similar to that of FIG. 4. In particular, the process (first process) of the sustain pulse cycle (C) control is performed by the first processing unit 101, and the process (second process) of the adjustment (correction) thereof is performed by the second processing unit 102.

The field of (1) in FIG. 5 has a configuration similar to the (1) of FIG. 4, and shows a case where the length of each SF (Ts) becomes relatively large when the N (or C) increases when the H is small. The sustain pulse of each SF (Ts) is configured only by one type of sustain pulse cycle (e.g., Ca).

The field of (2) in FIG. 5 is similar to the (2) of FIG. 4 as it is where N (or C) becomes small when H is large, and furthermore, it shows a case of selecting and adjusting the cycle (C) combination of each SF (Ts) by the process of the second processing unit 102. According to this, the length of each SF (Ts) then becomes relatively large, and is adjusted to almost the same length as the field of (1). Herein, the sustain pulse of each SF (Ts) is configured by one or more than one type of sustain pulse cycle (e.g., two types of Cx, Cy). Note that, Ca and (Cx, Cy) also have a common part (e.g., when Cx=Ca).

Between the states of (1) and (2), N and C are increased and decreased while maintaining the weight of each SF, and each SF is crammed with no space in the field (1V period), and furthermore, a combination of cycles (C) is selected so that the start and end timings of each SF (Ts) become the same as much as possible. The selection and adjustment are obtained by a simple calculation. According to this, between the states, the start (and end) timing of each SF and the start and end timing of the field as well as the weighted emission center of each SF and the weighted emission center (G) of the field (F) become almost the same. The vacancy (rest period) is not provided after the last SF of the field.

As described above, the SF (Ts) length and the position are maintained (made constant) along with the Ts control corresponding to the image content (display load ratio (H) etc.), and in particular, the field weighted emission center (G) becomes almost the same between the field before and after the change. Accordingly, when the field (frame) is displayed, occurrence of flickers (blinks) is suppressed.

<Sustain Pulse Cycle Control>

Figure 6:
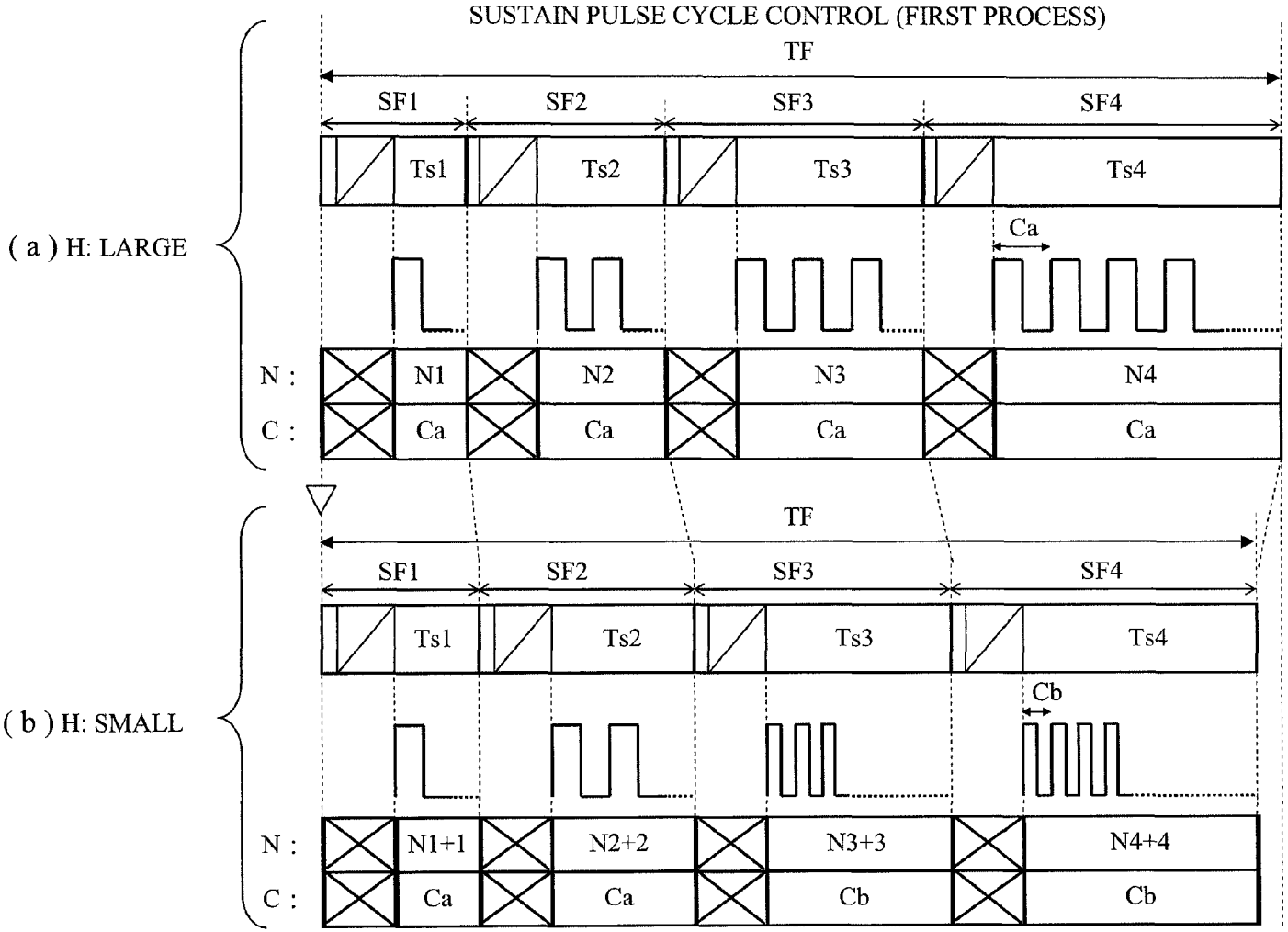
FIG. 6 is a diagram showing a change in the field configuration and timing by the sustain pulse cycle control (first process) in the PDP device of the first embodiment of the present invention.

In FIG. 6, a basic (similar to conventional art) sustain pulse cycle (C) control according to the present embodiment will be described by way of example. This control corresponds to FIG. 4 and the process (first process) in the first processing unit 101.

The (a) of FIG. 6 shows a field configuration before a change when the display load ratio (H) of SF is large, and the (b) of FIG. 6 shows a field configuration after a change when the display load ratio (H) of SF is small. A certain field corresponding to the H variation changes from the state (a) to state (b) by the sustain pulse cycle (C) control.

In the (a) of FIG. 6, the number (N) of sustain pulses of the sustain period (Tsi) of each SF (SFi) is Ni for SFs (SF1 to SF4) of n=4 of the field. The field configuration is a configuration in which each SF weight and Ni are lined in the order from the smallest is adopted. All the sustain pulse cycle (C) of each SF is the same (Ca). The SF weight (luminance ratio) is, for example, 1:2:3:4.

In the (b) of FIG. 6, for SFs (SF1 to SF4) of n=4 of the field, the number (N) of sustain pulses of the sustain period (Tsi) of each SF (SFi) is changed to (N1+1, N2+2, N3+3, N4+4) with respect to the state (Ni) of the (a). Each SF weight is maintained. One part is changed according to the H about the sustain pulse cycle (C) of each SF. For instance, the cycle is the original cycle (Ca) in SF1 and SF2, but the cycle is changed to a cycle (Cb) having a length different from Ca in SF3 and SF4.

Between the states of (a) and (b), the timings of each SF (Ts) is slightly shifted. Furthermore, only one type of cycle (Ca or Cb) is used for every SF (Ts), and thus it is difficult to have the end timing of the field before and after the change always the same. The timings match only at the field start location (triangular mark).

<Sustain Pulse Cycle Combining Control>

Figure 7:
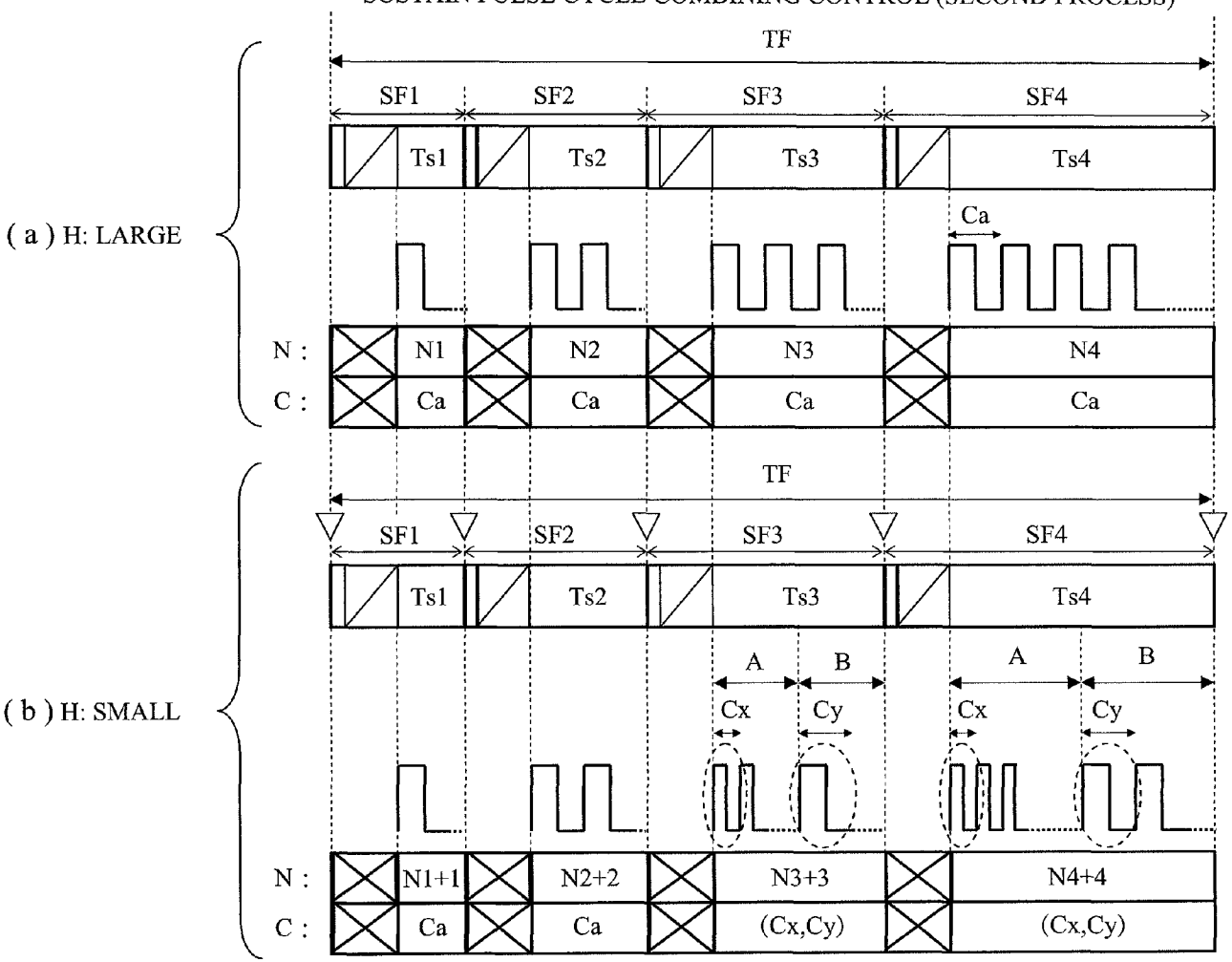
FIG. 7 is a diagram showing a change in the field configuration and timing by the sustain pulse cycle combining control (second process) in the PDP device of the first embodiment of the present invention.

With reference to FIG. 7, an example of the control (sustain pulse cycle (C) combining control adapted to the display load ratio (H)) in the present embodiment will be described. The control corresponds to the control added with the second process in the second processing unit 102 to the first process of FIG. 5 and FIG. 6.

In FIG. 7, (a) is a field configuration before a change similar to the (a) of FIG. 6, and (b) is a field configuration after the change when the display load ratio (H) of SF is small. A certain field corresponding to the H variation is changed from the state (a) to the state (b) according to the present sustain pulse cycle (C) combining control. The change of state from (a) to (b) is done through the state of (b) of FIG. 6 by the first processing unit 101 in the meantime.

In the (b) of FIG. 7, for SFs (SF1 to SF4) of n=4 in the field, the number (N) of sustain pulses of the sustain period (Tsi) of each SF (SFi) is respectively changed to, for example, (N1+1, N2+2, N3+3, N4+4) with respect to the state (Ni) of (a) similar to the above. Each SF weight is maintained. Meanwhile, a configuration for a combination of a plurality of types (two types in the present example) of cycles (C) is used for the sustain pulse cycle (C) of each SF. The cycle is the original cycle (Ca) in SF1, SF2 and other than that, it is changed to a configuration for a combination of two types of cycles (Cx, Cy) in SF3 and SF4.

Specifically, Ts3 of SF3 and Ts4 of SF4 are respectively divided into a former first period (A) and a latter second period (B). The sustain pulse of the first type of cycle (Cx) is repeated in the first period (A), and the sustain pulse of the second type of cycle (Cy) is repeated in the second period (B) in these configurations.

Between the states of (a) and (b), the timing of each SF (Ts) is made almost the same (triangular mark) by the combination of cycles (C). Further, since a plurality of types of cycles can be selected for every SF (Ts), the end timings of the fields before and after change can easily be made the same (triangular mark). The precision of timing matching is also improved at least compared to the conventional art (in which only one type of cycle is selected).

Still further, for instance, in the case of combining cycles (C) in each Ts 73, the weighted emission center becomes slightly closer to the back side and stabilized by arranging the relatively shorter cycle (e.g., Cx) to former side and the relatively longer cycle (e.g., Cy) to latter side.

As a target of change (adjustment) of combination of cycles (C) in the present control, some or all of the SFs including the SF having a largest weight (e.g., last SFn) of the plurality of SFs of the field. That is, a uniform control at field unit (targeting all SF) and a control targeting on part of the SF group (excluding low-order SF) in the field are possible.

The C may be changed in the field before and after the change in the present control, and the number of total sustain pulses in the field and the number (N) of sustain pulses of Ts in each SF may be maintained the same.

According to the first embodiment described in the foregoing, flickers (blinks) etc. caused by variations in length, timing and weighted emission center of each SF and Ts 73 can be suppressed even if the image content (display load ratio (H)) is changed, and the display quality can be ensured. In the configuration using only one type of sustain pulse cycle (C) as in the conventional art, it is difficult to align the timing and the weighted emission center at start and end of the field and SF and detailed control could not be made. In the present embodiment, however, the timing and the weighted emission center of the field and SF can be easily aligned by the configuration using the combination of two or more types of sustain pulse cycles (C) in the Ts 73, and so a detailed control can be made.

Note that, since the process result (D2) of the first processing unit 101 is the intermediate state of the target process (to output D3), a configuration of integrating the first processing unit 101 and the second processing unit 102 and outputting only the target process result (D3) can be adopted. In addition, a configuration in which the order of processes of changing N and C, calculation of J and the like is changed may be adopted.

Second Embodiment

Next, a PDP device of a second embodiment of the present invention will be described with reference to FIG. 8 and FIG. 9. The second embodiment has a basic configuration similar to that of the first embodiment, and the following (A) and (B) controls are performed with respect to display of a field group as a control to be added to the control of the first embodiment (sustain pulse cycle (C) combining control).

First, in the (A) first control, presence of scene change is detected as the image content (outline) according to the APL differential value between image frames (f), where the control of the first embodiment is turned OFF (not applied) when scene change is found, and the control of the first embodiment is turned ON (applied) when scene change is not found. The (A) first control prioritizes the variation in luminance and weighted emission center position that obviously exist in the original image content.

Further, when turning ON the control of the first embodiment in the (A) first control, the (B) second control is further performed. In the (B) second control, according to a range of a predetermined division in the entire range of the display load ratio (H), the control of the first embodiment is executed if within the range and the control of the first embodiment is not executed if outside the range, and for example, it is responded by changing the timing (maximum length) of the field to be associated in a step-wise manner according to the range.

Figure 8:
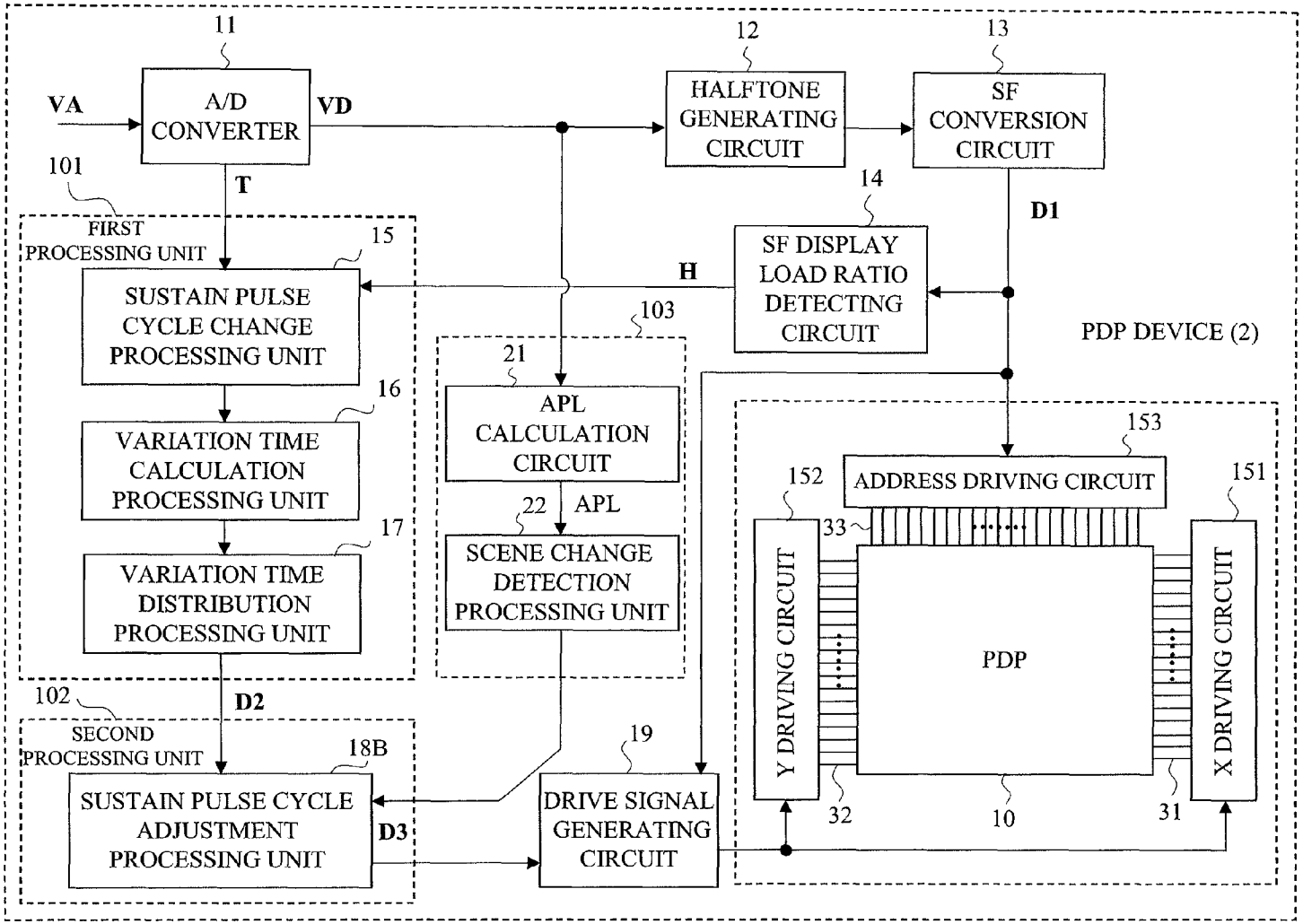
FIG. 8 is a diagram showing an entire block configuration of a PDP device according to a second embodiment of the present invention.

In FIG. 8, a block configuration of the PDP device of the second embodiment is shown. The PDP device includes a third processing unit 103 {APL (average luminance level) calculation circuit 21, scene change detection processing unit 22} corresponding to the (A) first control, which are portions different from the configuration (FIG. 1) of the first embodiment. Further, a process of the sustain pulse cycle (C) adjustment processing unit 18B of the second processing unit 102 corresponds to the input (presence of scene change) from the third processing unit 103.

The APL calculation circuit 21 calculates the APL (average luminance level) of the image frame (f) of the input signal (image signal (VD)) and outputs the same to the scene change detection processing unit 22. The image frame (f) and the field (F) are associated. The scene change detection processing unit 22 determines the APL differential value between the previous and subsequent image frames (f), where as occurrence of scene change is detected (scene change found) when the APL differential value exceeds a predetermined threshold value. The scene change detection processing unit 22 outputs the information of the presence of scene change to the C adjustment processing unit 18B.

When recognizing that scene change has not occurred (no scene change) between the image frames from the information on the presence of scene change from the scene change detection processing unit 22, the C adjustment processing unit 18B appropriately selects and changes a configuration of combination of the sustain pulse cycles (C) for every SF of the corresponding field similar to the process of the first embodiment. Consequently, the relevant field is maintained as almost the same as the start timing of each SF of the immediately previous field. On the other hand, when recognizing that the scene change presents, the C adjustment processing unit 18B obtains the data (D3) of field configuration by the sustain pulse cycle (C) which is set (once changed) by the variation time distribution processing unit 17 (first processing unit 101) and the like without performing the process (C combination selection) as in the first embodiment and outputs the data to the drive signal generating circuit 19.

Moreover, the (B) second control may be performed as the following. First, the APC is generally performed in the conventional PDP device (FIG. 3 and FIG. 4). That is, in the case of APC, a control is performed such that the number of total sustain pulses decreases as the APL or display load ratio (H) increases with respect to the display image. In other words, each sustain period (Ts) has a shorter length according to the decrease in the number (N) of sustain pulses. The start timing of each SF is shifted from that of the previous field when, for example, each SF of the field is arranged to be temporally crammed towards the front with no space. Therefore, it may be not realistic to perform the control to maintain the start timing of each SF of the field like in the control (second process) of the first embodiment across the entire range of the APL (or H). When executing the control of the first embodiment as it is, the sustain pulse cycle (C) becomes too small when the temporal difference of the field period (TF) between the previous frame and the current frame is greater than or equal to a certain degree for instance, whereby the discharge timing becomes unstable and display unevenness may occur.

In view of the above, in the (B) second control, the start timing of each SF is maintained and the flicker etc. are suppressed in the case where the image content does not have a large variation in the APL (or H) between frames (fields) (when APL differential value within a predetermined range and no scene change), and the start timing of each SF to be maintained is changed in a step-wise manner with respect to the change in the number (N) of sustain pulses by the APC for realistic response.

Figure 9B:
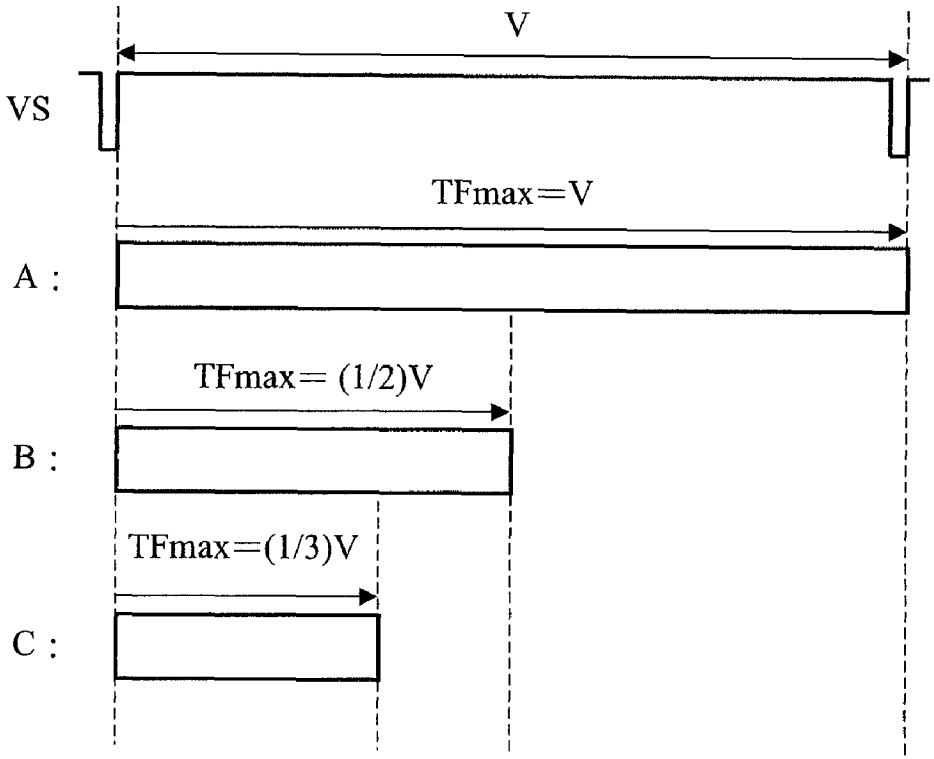
FIG. 9B is a diagram showing a maximum length of field corresponding to the divided ranges in the PDP device of the second embodiment of the present invention.
Figure 9A:
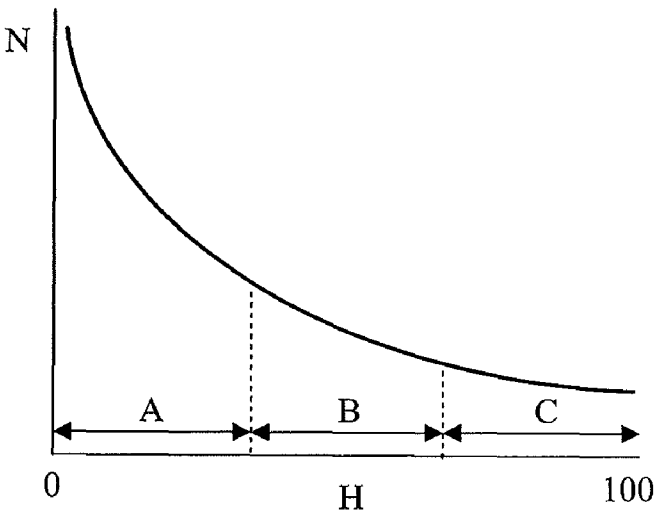
FIG. 9A is a diagram showing a condition of a second control showing ranges for dividing display load ratio (H) in the PDP device of the second embodiment of the present invention.

In FIG. 9A and FIG. 9B, an example in which the entire range (0 to 100%) of the display load ratio (H) is divided into a plurality of ranges (regions) and the control of the first embodiment is applied in a step-wise manner for each range is shown. In FIG. 9A, the entire range of the display load ratio (H) is divided into three of A: small load region, B: medium load region, and C: large load region according to the general magnitude of H. In FIG. 9B, a maximum length (TFmax) of the field period (TF) is defined according to each region (A to C). For instance, TFmax=1V in the region A, TFmax=(½) V in the region B, and TFmax=(⅓) 1V in the region C.

With respect to the variation in display load ratio (H) in each region (A to C), the maximum length (TFmax) of the field period (TF) is applied according to each region (A to C) without performing the control of the first embodiment so as to make the field within the range of the maximum length. For example, when the H variation between the fields is within a predetermined range (within each region), the number (N) of sustain pulses of each SF is maintained constant. Accordingly, flicker etc. is mitigated. When a large variation in display load ratio (H) occurs across the regions (A to C) (e.g., from A to C) between the fields in response to occurrence of scene change, the control of the first embodiment is not executed.

According to the second embodiment described above, the flicker etc. particularly caused by the change in the low-order SF configuration (change in luminance having a large influence) in the field configuration is suppressed according to the image content (scene change etc.) and the display quality can be ensured.

Third Embodiment

Figure 10:
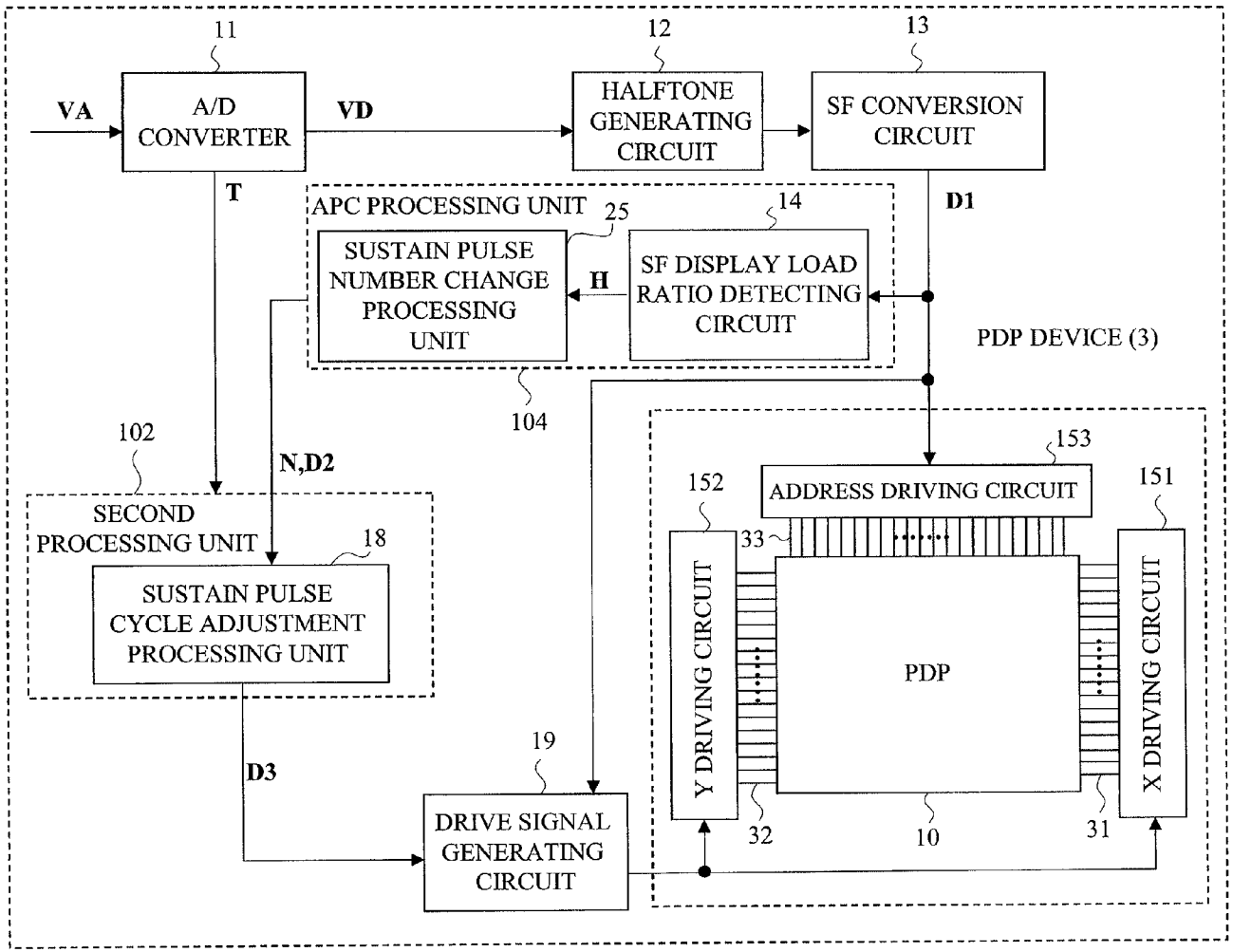
FIG. 10 is a diagram showing an entire block configuration of a PDP device of a third embodiment of the present invention.

A PDP device of a third embodiment will be described with reference to FIG. 10. In the third embodiment, a configuration including an APC processing unit 104 without the first processing unit 101 is adopted. The APC processing unit 104 includes a number (N) of sustain pulses change processing unit 25 in addition to the SF display load ratio (H) detecting circuit 14. The APC process is similar to those in FIG. 3 and FIG. 4, and the change of cycle (C) is not performed.

In the APC processing unit 104, the display load ratio (H) of the SF is calculated by the SF display load ratio detecting circuit 14 based on the display data (D1). The N change processing unit 25 computes the number (N) of sustain pulses etc. of each SF as information necessary for the APC based on the information of the display load ratio (H) of the SF. For instance, the larger the display load ratio (H) of the SF is, the smaller the number (N) of sustain pulses of Ts 73 is. Thus, the APC processing unit 104 once determines the field configuration including the position and length of each SF (Ts 73) of the field and outputs information of N and the like and the display data (N, D2) representing the field configuration.

And, in the second processing unit 102, a process similar t the above (e.g., FIG. 7) based on the data (N, D2) from the APC processing unit 104. That is, the second processing unit 102 performs the process for adjusting the field after the change to have a combination of sustain pulse cycles (C) of the Ts 73 of each SF with respect to the original configuration.

In this manner, not limited to a specific sustain period control, effects similar to those described above can be achieved by applying the sustain pulse cycle combining control.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention is applicable to a grayscale display device such as a PDP device.

What is claimed is:

1. A plasma display device including a plurality of first electrodes and second electrodes as display electrodes and performing image display using a plurality of subfields including a reset period, an address period, and a sustain period, the plasma display device comprising:

a detection circuit configured to detect a display load ratio for each subfield of the plurality of subfields;

a generation circuit configured to generate a plurality of sustain pulses having different cycles to be applied to the plurality of first and second electrodes during the sustain period; and a control circuit configured to control a combination of the plurality of sustain pulses according to the display load ratio of every subfield detected by the detection circuit, wherein, according to control of the combination of the plurality of sustain pulses by the control circuit, a variation in a period from start to end of each subfield of the plurality of subfields is suppressed even when the total number of sustain pulses to be applied in a period of one field is changed.

2. The plasma display device according to claim 1, wherein a subfield configured to control the combination of the plurality of sustain pulses by the control circuit is a part of subfields including a subfield having a maximum luminance ratio.

3. The plasma display device according to claim 1, wherein a sustain pulse having a large cycle is applied temporally later when applying the plurality of sustain pulses having different cycles in the sustain period of the subfield.

4. A method of driving the plasma display including a plurality of first electrodes and second electrodes as display electrodes for performing image display using a plurality of subfields including a reset period, an address period, and a sustain period, the method comprising the steps of:

generating a plurality of sustain pulses having different cycles to be applied to the plurality of first and second electrodes during the sustain period; and controlling a combination of the plurality of sustain pulses according to a display load ratio of every subfield of the plurality of subfields, wherein, according to a control of the combination of the plurality of sustain pulses, a variation in a period from start to end of each subfield of the plurality of subfields is suppressed even when the total number of sustain pulses to be applied in a period of one field is changed.

5. The method of driving the plasma display according to claim 4, wherein a subfield configured to control the combination of the plurality of sustain pulses is a part of subfields including a subfield having a maximum luminance ratio.

6. The method of driving the plasma display according to claim 5, wherein a vacant period where no driving pulse is applied is not created between each subfield of the plurality of subfields.

7. The method of driving the plasma display according to claim 4, wherein a sustain pulse having a large cycle is applied temporally later when applying the plurality of sustain pulses having different cycles in the sustain period of the subfield.

* * * * *